US005113628A

United States Patent [19]

Richardson et al.

[11] Patent Number: 5,113,628

[45] Date of Patent: * May 19, 1992

[54] RAILLESS REFRIGERATOR DISPLAY DOOR

[75] Inventors: Richard J. Richardson, Simi Valley; Bennie R. Downing, Thousand Oaks, both of Calif.

[73] Assignee: Anthony's Manufacturing Company, Inc., San Fernando, Calif.

[ * ] Notice: The portion of the term of this patent subsequent to Mar. 24, 2009 has been disclaimed.

[21] Appl. No.: 644,072

[22] Filed: Jan. 18, 1991

Related U.S. Application Data

[63] Continuation-in-part of Ser. No. 585,602, Sep. 20, 1990.

[51] Int. Cl.[5] ..... E06B 3/00

[52] U.S. Cl. ..... 52/171; 52/475; 52/790; 52/788

[58] Field of Search ..... 52/171, 475, 790, 788, 52/789, 172

[56] References Cited

U.S. PATENT DOCUMENTS

| | | | |
|---|---|---|---|
| 834,968 | 11/1906 | Christenson . | |
| 1,117,340 | 11/1914 | Crittall . | |
| 1,636,593 | 7/1927 | Dennis . | |
| 1,877,336 | 9/1932 | Lovell et al. . | |
| 1,975,895 | 10/1934 | Geyer . | |
| 2,173,649 | 9/1939 | Firner . | |
| 2,173,664 | 9/1939 | Shutts . | |
| 2,205,522 | 6/1940 | Fix . | |
| 2,282,831 | 5/1942 | Shutts . | |
| 2,348,307 | 5/1943 | Richardson . | |
| 2,383,691 | 8/1945 | Smith . | |
| 2,489,962 | 11/1949 | Hardwick . | |
| 2,589,064 | 3/1952 | Drake . | |
| 2,607,086 | 6/1952 | Saunders | 52/171 |
| 2,679,074 | 7/1952 | Bryden | 52/475 |
| 2,708,774 | 5/1955 | Seelen . | |
| 2,774,117 | 12/1956 | Eckel . | |
| 2,872,713 | 2/1959 | Haas . | |
| 2,873,486 | 2/1959 | Hughes . | |
| 2,877,516 | 3/1959 | Bobel . | |
| 2,877,761 | 3/1959 | Schibley . | |
| 2,880,475 | 4/1959 | Mills . | |
| 2,904,819 | 9/1959 | Seaman . | |
| 2,909,814 | 10/1959 | Schwartz . | |
| 2,975,492 | 3/1961 | Persson . | |
| 2,987,782 | 6/1961 | Kurowski . | |
| 3,024,880 | 3/1962 | Burmeister . | |
| 3,030,673 | 4/1962 | London . | |
| 3,054,153 | 9/1962 | Partsch . | |
| 3,077,643 | 2/1963 | Horner . | |
| 3,170,456 | 2/1965 | Moss et al. . | |
| 3,280,523 | 10/1966 | Stroud et al. . | |
| 3,300,900 | 1/1967 | Risk et al. . | |
| 3,331,159 | 7/1967 | Cooke et al. . | |
| 3,335,785 | 8/1967 | Anderson et al. . | |
| 3,339,225 | 9/1967 | Booth . | |
| 3,396,490 | 8/1968 | Dukas . | |

(List continued on next page)

FOREIGN PATENT DOCUMENTS 0018468 11/1980 European Pat. Off. .

(List continued on next page)

OTHER PUBLICATIONS

"Structural Spacer Glazing", by C. Gregory Carney, Glass Magazine, Mar. 1988, pp. 173-175.

*Primary Examiner*—David A. Scherbel
*Assistant Examiner*—Wynn E. Wood
*Attorney, Agent, or Firm*—Poms, Smith, Lande & Rose

[57] ABSTRACT

A railless refrigerator display door constructed with two or more glass panels and having a peripheral door frame extending around the sides of the door and at the inside of the door without covering the outside glass surface of the door. Sealant is used to bond the glass panels to peripheral spacers separating the panels and to C-section structures which extend peripherally around the sides of the door. The door frame is also bonded to the C-section structures and glass panels by the sealant. Rubber bumpers attached to the C-section structures reduce heat transfer from the inside glass panel to the outside glass panel. As such, mechanical fasteners such as nuts, bolts or screws are not needed for the purpose of holding the refrigerator door together.

19 Claims, 4 Drawing Sheets

U.S. PATENT DOCUMENTS

| | | | |
|---|---|---|---|
| 3,411,247 | 11/1968 | Fleming . | |
| 3,418,779 | 12/1968 | Jendrisak et al. . | |
| 3,425,163 | 2/1969 | Horgan, Jr. . | |
| 3,442,059 | 5/1969 | Kessler . | |
| 3,577,973 | 5/1971 | Katona . | |
| 3,629,972 | 12/1971 | Rehberg et al. . | |
| 3,662,429 | 5/1972 | Johnson et al. . | |
| 3,667,179 | 6/1972 | Eisenberg . | |
| 3,855,995 | 12/1974 | Bentley . | |
| 3,875,706 | 4/1975 | Okawa . | |
| 3,889,434 | 6/1975 | Shelver . | |
| 3,919,023 | 11/1975 | Bowser et al. . | |
| 3,919,821 | 11/1975 | Goetz . | |
| 3,949,526 | 4/1976 | Sherlock et al. . | |
| 3,965,638 | 6/1976 | Newman . | |
| 3,975,881 | 8/1976 | Ninowski, Jr. . | |
| 4,015,394 | 4/1977 | Kessler . | |
| 4,030,263 | 6/1977 | Lacombe . | |
| 4,042,736 | 8/1977 | Flint . | |
| 4,043,091 | 8/1977 | Katona . | |
| 4,055,031 | 10/1977 | Okawa et al. . | |
| 4,084,347 | 4/1978 | Brown . | |
| 4,097,320 | 6/1978 | Braver et al. . | |
| 4,109,432 | 8/1978 | Pilz . | |
| 4,143,493 | 3/1979 | Bool . | |
| 4,145,844 | 3/1979 | Kaspar . | |
| 4,149,348 | 4/1979 | Pyzenski . | |
| 4,155,205 | 5/1979 | Polman . | |
| 4,205,486 | 6/1980 | Guarnacci . | |
| 4,223,482 | 9/1980 | Barroero et al. . | |
| 4,226,063 | 10/1980 | Chenel . | |
| 4,295,305 | 10/1981 | Shelver . | |
| 4,348,435 | 9/1982 | Mistrick et al. . | |
| 4,368,226 | 1/1983 | Mucaria . | |
| 4,382,177 | 5/1983 | Heaney | 52/171 |
| 4,393,105 | 7/1983 | Kreisman . | |
| 4,412,708 | 11/1983 | Palka . | |
| 4,416,101 | 11/1983 | Derner et al. . | |
| 4,429,509 | 2/1984 | Vachet et al. . | |
| 4,454,703 | 7/1984 | Sitzler et al. . | |
| 4,459,789 | 7/1984 | Ford . | |
| 4,514,948 | 5/1985 | Meign et al. . | |
| 4,552,790 | 11/1985 | Francis . | |
| 4,588,235 | 5/1986 | Barroero . | |
| 4,622,249 | 11/1986 | Bowser . | |
| 4,640,078 | 2/1987 | Haffer . | |
| 4,658,553 | 4/1987 | Shinagawa . | |
| 4,671,582 | 6/1987 | Stromquist et al. . | |
| 4,691,486 | 9/1987 | Niekrasz et al. . | |
| 4,696,078 | 9/1987 | Stromquist . | |
| 4,807,419 | 2/1989 | Hodek et al. . | |
| 4,817,335 | 4/1989 | Adell . | |
| 4,818,043 | 4/1989 | Borgen . | |
| 4,822,649 | 4/1989 | Canaud et al. . | |
| 4,890,438 | 1/1990 | Tosa et al. . | |
| 4,940,297 | 7/1990 | Borgen . | |
| 4,950,344 | 8/1990 | Glover et al. . | |
| 4,961,975 | 10/1990 | Bejnar . | |
| 4,994,309 | 2/1991 | Reichert et al. . | |
| 5,024,023 | 6/1991 | Kostos et al. . | |

FOREIGN PATENT DOCUMENTS

| | | |
|---|---|---|
| 0019020 | 11/1980 | European Pat. Off. . |
| 0041840 | 12/1981 | European Pat. Off. . |
| 0082164 | 6/1983 | European Pat. Off. . |
| 0108677 | 5/1984 | European Pat. Off. . |
| 0124397 | 11/1984 | European Pat. Off. . |
| 0124749 | 11/1984 | European Pat. Off. . |
| 0162344 | 11/1984 | European Pat. Off. . |
| 0138782 | 4/1985 | European Pat. Off. . |
| 0163166 | 12/1985 | European Pat. Off. . |
| 0168672 | 1/1986 | European Pat. Off. . |
| 0176091 | 4/1986 | European Pat. Off. . |
| 0213970 | 3/1987 | European Pat. Off. . |
| 0231676 | 8/1987 | European Pat. Off. . |
| 0249299 | 12/1987 | European Pat. Off. . |
| 0264002 | 4/1988 | European Pat. Off. . |
| 0264052 | 4/1988 | European Pat. Off. . |
| 0269470 | 6/1988 | European Pat. Off. . |
| 0288060 | 10/1988 | European Pat. Off. . |
| 0303330 | 2/1989 | European Pat. Off. . |
| 0313892 | 5/1989 | European Pat. Off. . |
| 0319695 | 6/1989 | European Pat. Off. . |
| 0351573 | 1/1990 | European Pat. Off. . |
| 0387204 | 9/1990 | European Pat. Off. . |
| 0388550 | 9/1990 | European Pat. Off. . |
| 0418461 | 3/1991 | European Pat. Off. . |
| 0432872 | 7/1991 | European Pat. Off. . |
| 2840656 | 3/1980 | Fed. Rep. of Germany . |
| 3543524 | 6/1987 | Fed. Rep. of Germany . |
| 1032616 | 6/1979 | Italy . |
| 1084120 | 5/1985 | Italy . |
| 1091235 | 7/1985 | Italy . |
| 1165175 | 4/1987 | Italy . |
| 1208888 | 7/1989 | Italy . |
| 1216012 | 2/1990 | Italy . |
| WO84/00191 | 1/1984 | PCT Int'l Appl. . |
| WO88/07617 | 10/1988 | PCT Int'l Appl. . |
| 7604769 | 3/1977 | Sweden . |
| 0503878 | 2/1971 | Switzerland . |
| 1301651 | 1/1973 | United Kingdom . |
| 1398434 | 6/1975 | United Kingdom . |
| 1482372 | 8/1977 | United Kingdom . |
| 2023209 | 12/1979 | United Kingdom . |
| 1579838 | 11/1980 | United Kingdom . |
| 2075435 | 11/1981 | United Kingdom . |
| 1581946 | 12/1990 | United Kingdom . |

Fig. 4.
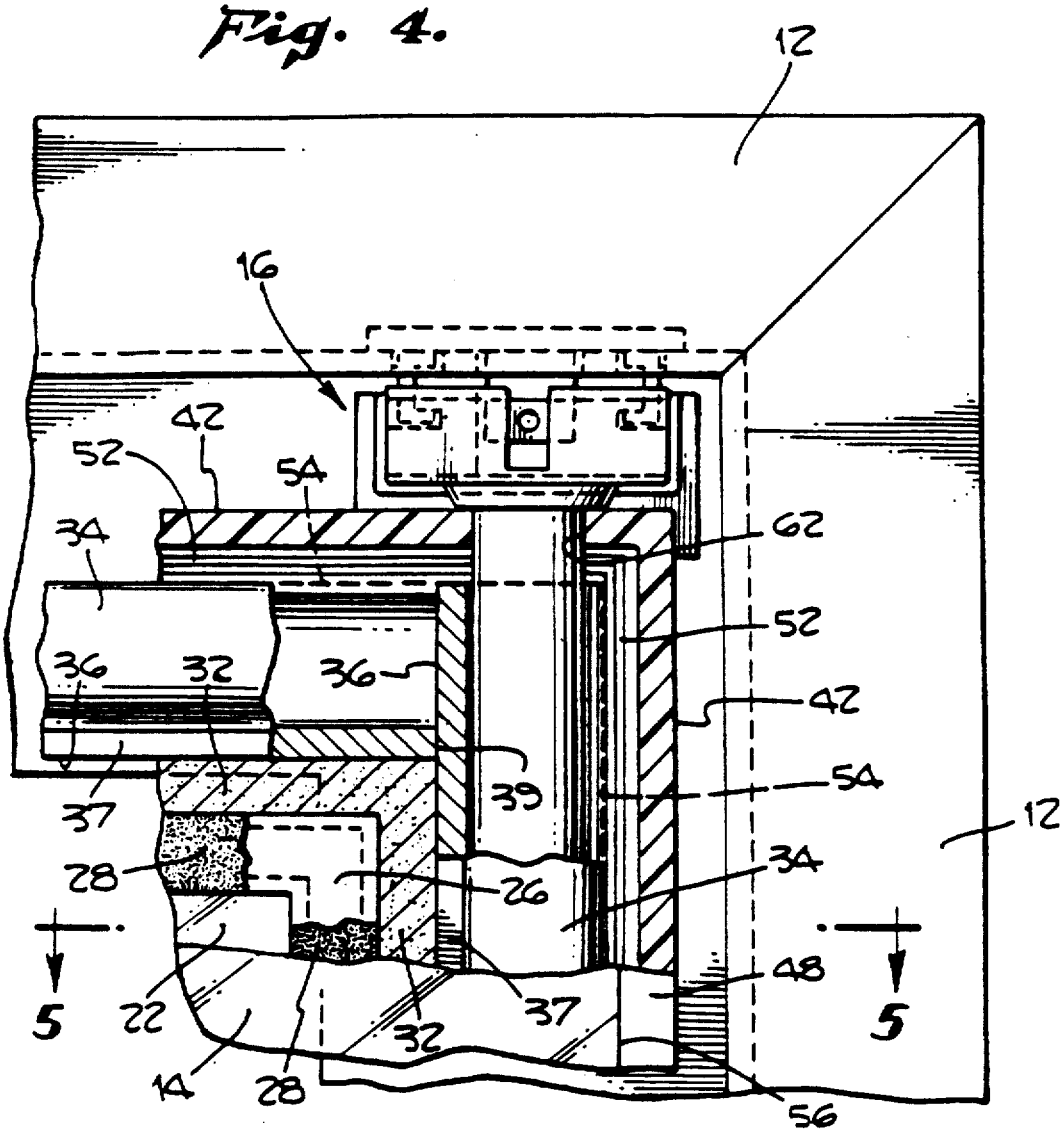
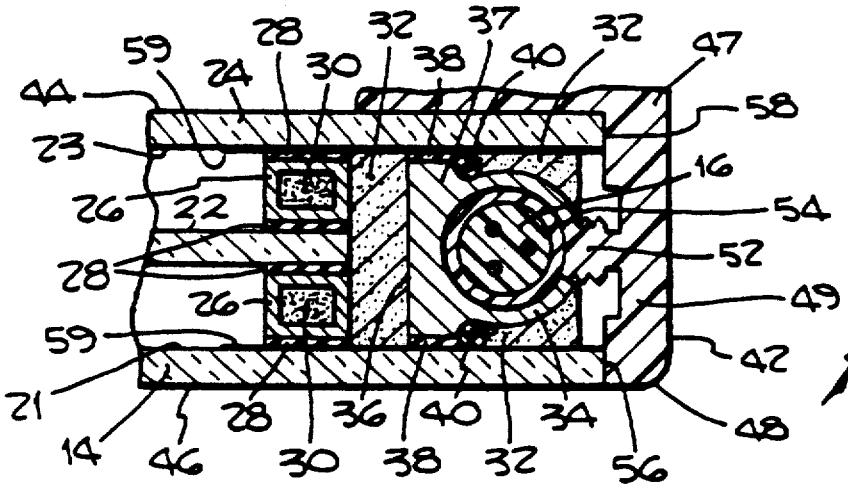
Fig. 5.

RAILLESS REFRIGERATOR DISPLAY DOOR

CROSS-REFERENCE TO RELATED APPLICATION

This application is a continuation-in-part of application, Ser. No. 07/585,602, filed Sep. 20, 1990, and entitled "Glass Refrigerator Door Structure."

BACKGROUND OF THE INVENTION

The present invention relates generally to refrigerator doors, and more particularly to a railless refrigerator display door constructed with two or more glass panels and having a peripheral door frame extending around the sides of the door and at the inside of the door without covering the outside glass surface of the door.

Present commercial glass refrigerator doors typically have door frames which extend peripherally around the glass panels of the doors. Such door frames are used to hold the glass panels in place and extend peripherally around both the inside and outside glass surfaces of the doors. As a result, the door frames can be seen from the outside of the doors, distracting from the appearance of the glass doors. Such door frames are disclosed, for example, in U.S. Pat. Nos. 4,696,078, issued to Stromquist on Sep. 29, 1987; 4,671,582, issued to Stromquist, et al. on Jun. 9, 1987; 4,223,482, issued to Barroero, et al. on Sep. 23, 1980; 3,339,225, issued to Booth on Sep. 5 1967; and 3,331,159, issued to Cooke, et al. on Jul. 18, 1967.

SUMMARY OF THE INVENTION

It is an object of this invention to provide a railless refrigerator display door having a peripheral door frame that does not cover the outside glass surface of the door, presenting a more attractive and desirable refrigerator door.

It is another object of this invention to provide a railless refrigerator display door that is simple in design and inexpensive to manufacture.

It is still another object of this invention to provide a railless refrigerator display door which may be constructed with two or more glass panels.

It is still another object of this invention to provide a railless refrigerator display door which does not require mechanical fasteners such as nuts, bolts or screws to hold the structure together.

These and other objects and advantages are attained by a railless refrigerator display door constructed with two or more glass panels. The refrigerator door has a peripheral door frame extending around the sides of the door and at the inside of the door without covering the outside glass surface of the door. Sealant is used to bond the glass panels to peripheral spacers separating the panels and to C-section structures which extend peripherally around the sides of the door. The door frame is also bonded to the C-section structures and glass panels by the sealant. Rubber bumpers attached to the C-section structures reduce heat transfer from the inside glass panel to the outside glass panel. As such, mechanical fasteners such as nuts, bolts or screws are not needed for the purpose of holding the refrigerator door together.

The various features of the present invention will be best understood together with further objects and advantages by reference to the following description of the preferred embodiments taken in conjunction with the accompanying drawings.

BRIEF DESCRIPTION OF THE DRAWINGS:

FIG. 4 is a detailed cross-sectional view taken in the direction of arrows 4—4 shown in FIG. 2;

FIG. 5 is a detailed cross-sectional view taken in the direction of arrows 5—5 shown in FIG. 4 illustrating how three glass panels may be used for the railless refrigerator display door;

DESCRIPTION OF THE PREFERRED EMBODIMENTS:

The following specification taken in conjunction with the drawings sets forth the preferred embodiments of the present invention in such a manner that any person skilled in the art can make and use the invention. The embodiments of the invention disclosed herein are the best modes contemplated by the inventors for carrying out their invention in a commercial environment, although it should be understood that various modifications can be accomplished within the parameters of the present invention.

Figure 1:
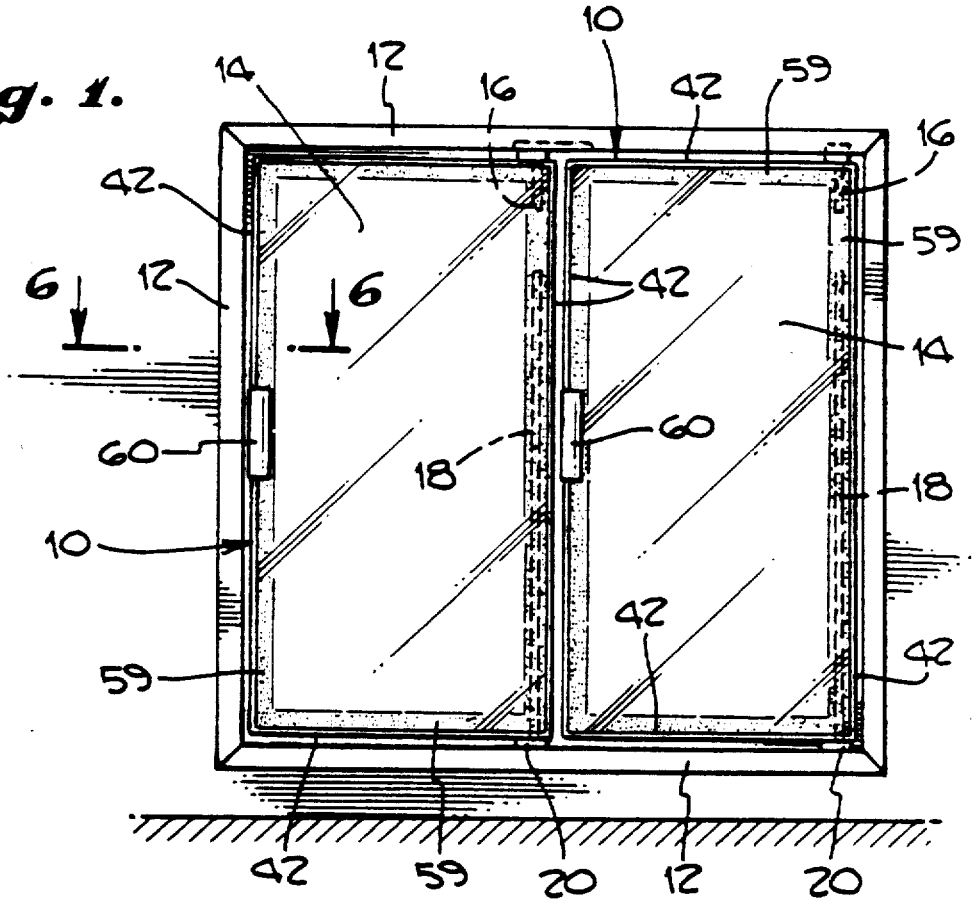
FIG. 1 is an elevational view of two railless refrigerator display doors of the present invention mounted on a cabinet or other supporting structure.

Referring to FIG. 1, two railless refrigerator display doors 10 of the present invention are shown installed or mounted on a cabinet or other supporting structure 12. The refrigerator display doors 10 have glass panels 14 which allow someone, such as a customer in a supermarket, to look through the panels 14 at frozen foods or other items kept inside a refrigerated area. However, it is important to note that the display door 10 of the present invention may be used as doors for any enclosed area whether or not the area is refrigerated.

A door hinge assembly 16 may be used at the upper right-hand corner of each railless refrigerator display door 10 and a torque rod 18 may be mounted in an adjustable anchor device 20 attached to the supporting structure 12 near the lower right-hand corner of the door 10.

Figure 2:
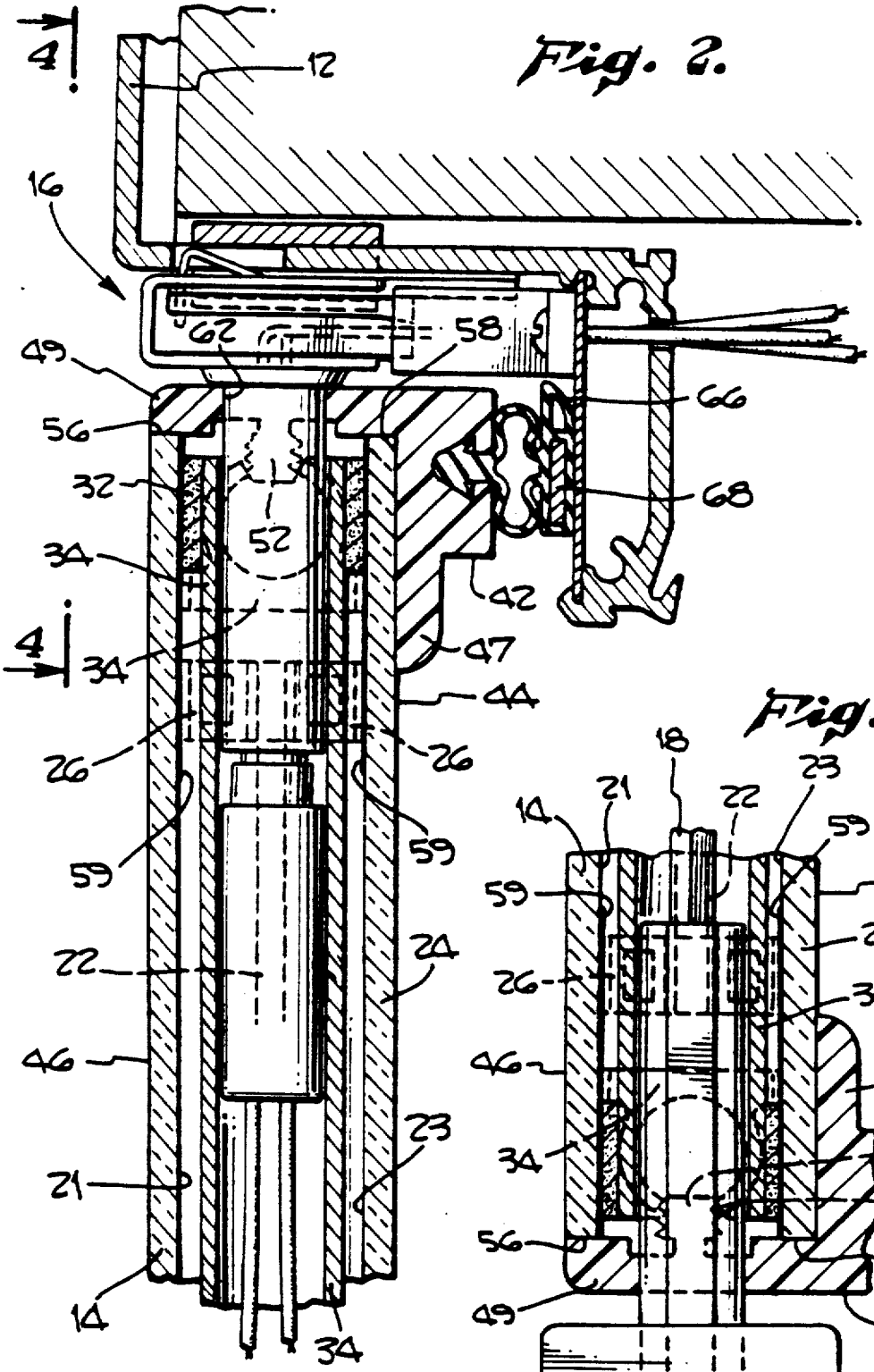
FIG. 2 is a detailed cross-sectional view showing how a door hinge assembly may be used at the upper right-hand corner of each railless refrigerator display door.

One such door hinge assembly 16 is shown in detail in FIGS. 2 and 4. This hinge assembly 16 is described in U.S. Pat. No. 4,671,582, issued to Stromquist, et al. on Jun. 9, 1987, the disclosure of which is hereby incorporated by reference thereto. However, any other suitable type of hinge assembly may be used instead of the hinge assembly 16 shown in FIGS. 2 and 4.

Figure 3:
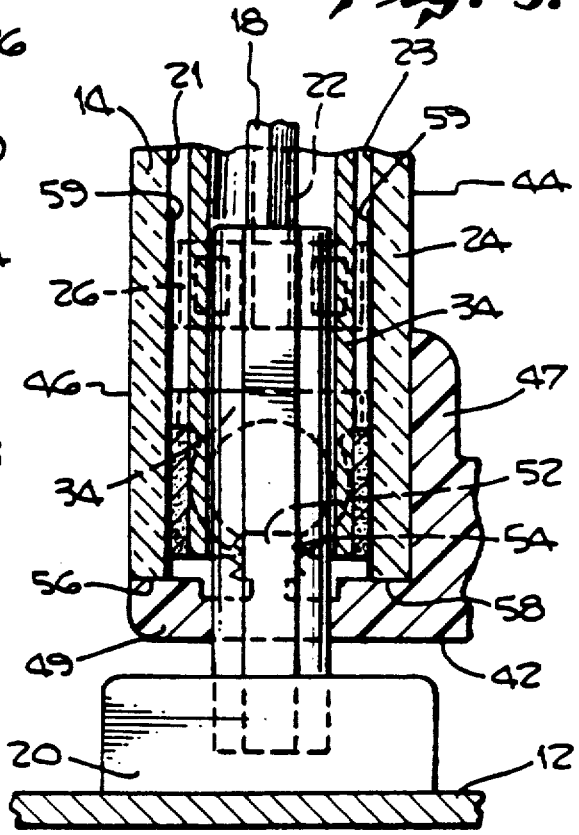
FIG. 3 is a detailed cross-sectional view showing how a torque rod may be used with an adjustable anchor device at the lower right-hand corner of each railless refrigerator display door.

FIG. 3 shows how the torque rod 18 may be mounted in an adjustable anchor device 20 at the lower right-hand corner of each refrigerator display door 10. A torque rod 18 and an adjustable anchor device 20, which may be used with door 10, are described in U.S. Pat. No. 4,696,078, issued to Stromquist on Sep. 29, 1987, the disclosure of which is hereby incorporated by reference thereto. It is important to note that any other suitable types of torque rods or anchor devices may also be used. For example, the torque rod 18 may be mounted in an aperture in the supporting structure 12.

Referring now to FIGS. 4 and 5, an embodiment of the railless refrigerator display door 10 is shown which uses outside, middle and inside glass panels 14, 22 and 24, respectively. The panels are spaced apart by two hollow spacers 26, preferably made of metal such as aluminum. However, any desirable material may be used for the spacers 26. Each hollow spacer 26 forms a rectangular shaped frame-like structure as shown in FIG. 4 and extends around the sides of the door 10. As shown in FIG. 5, the hollow spacers 26 are preferably filled with desiccant 30 used as a drying agent. Any suitable material may be used as desiccant 30. Rubber or plastic such as neoprene or vinyl insulators 28 are used between the spacers 26 and the glass panels 14, 22 and 24 as shown in FIG. 5.

Four hollow pipe-like structures 34 are located between glass panels 14 and 24 as shown in FIG. 5, each of which extends along a different side of the refrigerator display door 10. See FIG. 4, which shows how one pipe-like structure 34 extends across the top side of the door 10 while another pipe-like structure 34 extends along the right side of the door 10. Similarly, separate structures 34 extend along the left side and bottom side of the door 10. The structures 34 are preferably made out of aluminum, but any suitable material may be used.

Referring again to FIG. 5, each pipe-like structure 34 has a flat portion 36 and flanged ends 37. Rubber or neoprene insulators 38 are used between flanges 37 of each pipe-like structure 34 and glass panels 14 and 24 as shown in FIG. 5. Note how end 39 of horizontal pipe-like structure 34 in FIG. 4 abuts up against flat portion 36 of vertical pipe-like structure 34.

As shown in FIGS. 4 and 5, sealant 32 is placed in the void space between the pipe-like structures 34 and the hollow spacers 26, and between each pipe-like structure 34 and glass panels 14 and 24. Sealant 32 bonds to structures 34, spacers 26, and glass panels 14, 22 and 24, positioning or holding panels 14, 22 and 24 in place. The preferred sealant 32 is polysulfide or polyurethane. However, any suitable thermal setting sealant may be used that hardens and bonds as described above.

The railless refrigerator display door 10 has a peripheral door frame 42 extending around the sides of the door 10. As such, frame 42 forms a generally rectangular-shaped frame. As shown in FIGS. 2, 3 and 5, frame 42 is in contact with or covers inside surface 44 of glass panel 24, but does not cover outside surface 46 of glass panel 14. As such, a more attractive or desirable railless refrigerator display door 10 results because only a small outside surface 48 of frame 42 appears at the front or outside of display door 10, or along the sides of structure 10. Note that the small outside surface of frame 42 may be curved if desired like surface 50 shown in FIG. 7.

Door frame 42 has a generally V-shaped cross-section with inside portion 47 and side portion 49. Portion 49 has a peripheral extension 52 extending peripherally around frame 42 which engages or snaps into elongated slots or openings 54 in the pipe-like structures 34 so that glass panels 14 and 24 are positioned with respect to frame 42 with peripheral edges 56 and 58 of panels 14 and 24, respectively, abutting up against portion 49 as shown in FIG. 5. As such, the railless refrigerator display door 10 is held together without mechanical fasteners such as nuts, bolts or screws.

Figure 6:
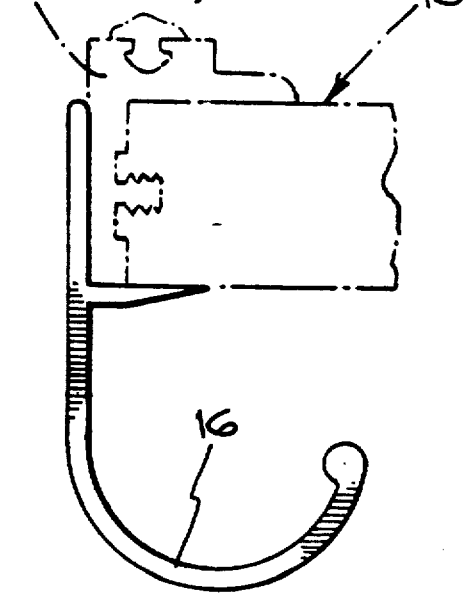
FIG. 6 is a detailed view taken in the direction of arrows 6—6 shown in FIG. 1 illustrating how a handle is attached to one of the railless refrigerator display doors (shown by dashed lines)

A handle 60 may be attached to the refrigerator display door 10 as shown in FIG. 6. In addition, as shown in FIGS. 2 through 4, door frame 42 has an aperture 62 at the upper right-hand corner thereof for hinge assembly 16, and an aperture 64 at the lower right-hand corner thereof for torque rod 18. It is important to note that handle 60 and apertures 62 and 64 may be positioned as desired to provide either a left- or right-hand door.

Referring again to FIG. 2, a door seal 66 with magnet 68 may be attached to the door frame 42 for the purpose of keeping the door 10 shut. As shown in FIG. 5, wires 40 may be positioned next to the pipe-like structures 34 and held in place by sealant 32.

Figure 7:
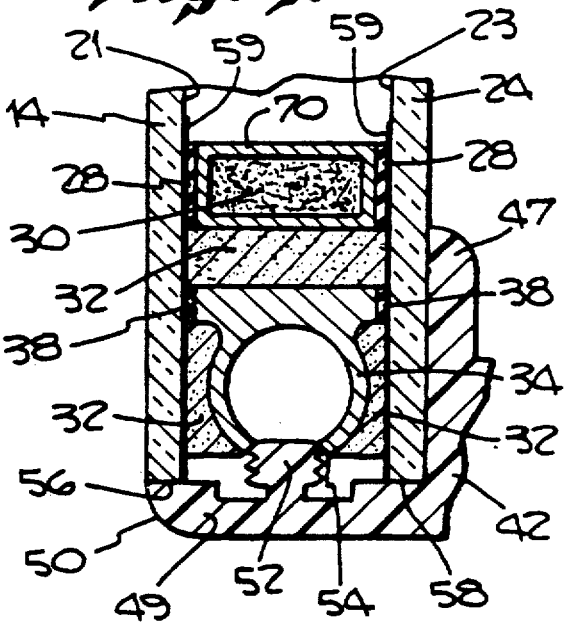
FIG. 7 is a detailed cross-sectional view taken like FIG. 5 showing another embodiment of the railless refrigerator display door using two glass panels.

Another embodiment of the railless refrigerator display door 10 is shown in FIG. 7. This embodiment uses only two glass panels 14 and 24 and a single peripheral hollow spacer 70 filled with desiccant 30. Note that sealant 32 is used to bond together panels 14 and 24, spacer 70 and pipe-like structures 34.

Preferably, as shown in FIGS. 1, 3, 5 and 7, borders 59 are painted (or otherwise coated) peripherally adjacent the edges 56 and 58 of glass panels 14 and 24 on surfaces 21 and 23, respectively. The painted borders 59 conceal from view structures 34 and spacers 26 or 70, providing a more attractive door 10.

Figure 8:
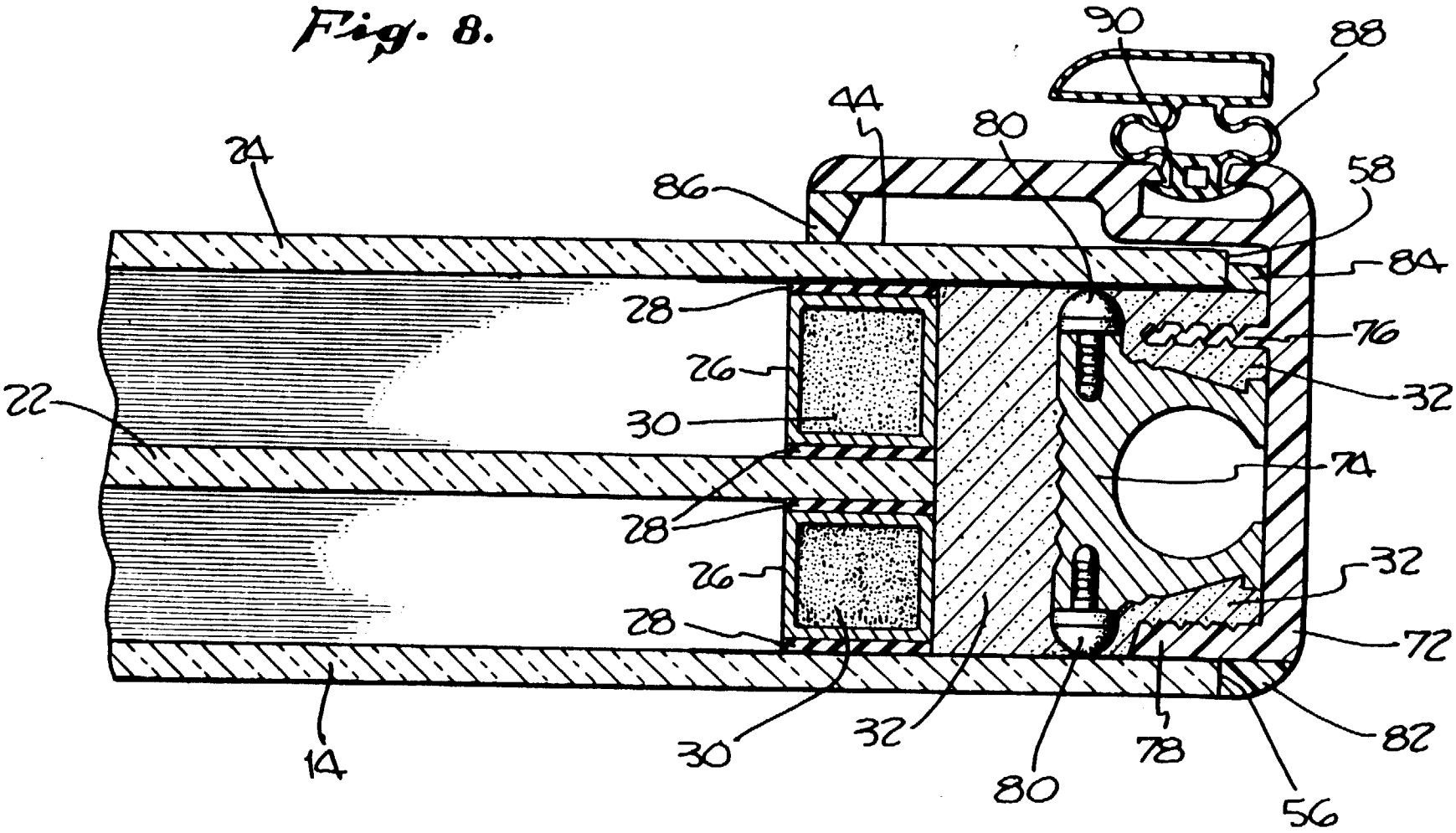
FIG. 8 is a detailed cross-sectional view taken like FIG. 5 showing still another embodiment of the railless refrigerator display door using three glass panels.

FIG. 8 shows still another embodiment of the railless refrigerator display door 10. This embodiment uses three glass panels 14, 22 and 24, two hollow spacers 26, preferably filled with dessicant 30, and insulators 28. However, only two panels 14 and 24 may be used, if desired, as shown in FIG. 7.

A different door frame 72 is used that has two peripheral extensions 76 and 78. Also, C-section structures 74 are used with this embodiment instead of the pipe-like structures 34 shown in FIGS. 5 and 7. Sealant 32 is used to bond together panels 14, 22 and 24, spacers 26, door frame 72 and the C-section structures 74. Note that extensions 76 and 78 of door frame 72 extend well into the sealant 32, helping to securely bond the frame 72 to the other parts of the embodiment. As such, this eliminates the need to use extensions 52 which snap into slots 54 as shown in FIGS. 5 and 7.

The C-section structures 74 are preferably extrusions made out of metal such as aluminum. However, any other metal or suitable material may be used instead of aluminum like reinforced resin such as fiberglass, or the like. Also, structures 74 may be protrusions, or molded, cast, machined, or otherwise fabricated. Rubber or plastic such as neoprene or vinyl bumpers 80 are attached to the C-section structures 74. The bumpers 80 preferably are elongated running the length of the structures 74. The bumpers 80 reduce heat transfer from inside panel 24 to outside panel 14, provide cushioning between the C-section structures 74 and the panels.

Door frames 42 and 72 may be made out of any suitable material such as metal, fiberglass, plastic, or the like. Preferably, material with a clear base resin, such as Keysor #1101-005 vinyl, sold by Keysor Corporation, is used for the door frames. Flexible extensions 82, 84 and 86 are thermally fused to door frame 72 using a dual durometer extrusion process and are used to cushion or seat the frame against peripheral edges 56 and 58 of panels 14 and 24, respectively, and inside surface 44 of panel 24. Preferably, a thermal plastic elastomeric material with a PVC Shore A 35-60 hardness is used for extensions 82, 84 and 86. However, any suitable plastic or other flexible (elastomeric) material may be used.

The above description discloses the preferred embodiments of the present invention. However, persons of ordinary skill in the art are capable of numerous modifications once taught these principles. Accordingly, it will be understood by those skilled in the art that changes in form and details may be made to the above-described embodiments without departing from the spirit and scope of the invention.

We claim:

1. A railless refrigerator display door comprising:
an outside glass panel and an inside glass panel;
a hollow spacer disposed between said glass panels, said spacer extending peripherally adjacent peripheral edges of said panels;
elongated structures disposed between said glass panels, said elongated structures extending peripherally adjacent said peripheral edges of said panels and peripherally about an outer periphery of said spacer;
a door frame extending peripherally about said elongated structures; and
sealant disposed between said panels, said sealant holding together said panels, said spacer, said elongated structures, and said door frame, said door frame having elongated extensions extending inwardly into said sealant adjacent said elongate structures.

2. The display door of claim 1 wherein said structures have bumper means attached thereto for reducing heat cold transfer between said panels.

3. The display door of claim 1 wherein said door frame engages said peripheral edges of said panels and covers a peripheral inside surface of said inside panel.

4. The display door of claim 1 wherein said hollow spacer is filled with a desiccant.

5. The display door of claim 1 further comprising rubber insulators disposed between said spacer and said panels.

6. The display door of claim 1 wherein said sealant is a thermal setting sealant.

7. The display door of claim 1 wherein said bumper means are made out of rubber.

8. A refrigerator display door comprising:
an outside glass panel, a middle glass panel and an inside glass panel;
a spacer disposed between said outside and middle glass panels;
a spacer disposed between said middle and inside glass panels;
elongated structures disposed between said inside and outside panels and extending peripherally adjacent peripheral edges of said inside and outside panels and peripherally about outside peripheries of said spacers;
a door frame extending peripherally about said elongated structures; and
sealant disposed between said inside and outside panels, said sealant holding together said spacers, said elongated structures, said inside, middle and outside panels, and said door frame, said door frame having elongated extensions extending inwardly into said sealant adjacent said elongated structures.

9. The display door of claim 8 wherein said door frame engages said peripheral edges of said inside and outside panels and covers a peripheral inside surface of said inside panel.

10. The display door of claim 8 wherein said hollow spacers are filled with a desiccant.

11. The display door of claim 8 further comprising rubber insulators disposed between said spacers and said panels.

12. The display door of claim 8 wherein said sealant is a thermal setting sealant.

13. The display door of claim 8 further comprising bumper means attached to said structures for reducing cold transfer between said inside and outside panels.

14. A refrigerator display door comprising:
an outside glass panel and an inside glass panel;
a spacer disposed between said glass panels, said spacer extending peripherally adjacent peripheral edges of said panels;
elongated structures disposed between said glass panels;
bumpers attached to each of said structures in order to reduce heat transfer between said inside and outside panels;
a door frame extending peripherally about said elongated structures; and
sealant disposed between said panels, said sealant holding together said panels, spacer, elongated structures, and door frame, said door frame having elongated extensions extending inwardly into said sealant adjacent said elongated structures.

15. The display door of claim 14 wherein said door frame engages said peripheral edges of said panels and covers a peripheral inside surface of said inside panel.

16. The display door of claim 14 wherein said hollow spacer is filled with a desiccant.

17. The display door of claim 14 further comprising rubber insulators disposed between said spacer and said panels.

18. The display door of claim 14 wherein said sealant is a thermal setting sealant.

19. The display door of claim 14 further comprising flexible extension means for cushioning said door frame against said panels.

* * * * *